US011431096B2

(12) United States Patent
Thyagarajan et al.

(10) Patent No.: US 11,431,096 B2
(45) Date of Patent: Aug. 30, 2022

(54) PATCH ANTENNA ASSEMBLY WITH GROUNDED POSTS

(71) Applicant: AVX Antenna, Inc., San Diego, CA (US)

(72) Inventors: Mukund Ranga Thyagarajan, San Diego, CA (US); Weichun Eric Lin, San Diego, CA (US); John Eric Shamblin, San Diego, CA (US); Mehak Garg, San Diego, CA (US); Manuel Rodriguez, Temecula, CA (US); Kenneth Mueller, San Diego, CA (US)

(73) Assignee: KYOCERA AVX COMPONENTS (SAN DIEGO), INC., San Diego, CA (US)

( * ) Notice: Subject to any disclaimer, the term of this patent is extended or adjusted under 35 U.S.C. 154(b) by 0 days.

(21) Appl. No.: 17/170,079

(22) Filed: Feb. 8, 2021

(65) Prior Publication Data

US 2021/0249775 A1 Aug. 12, 2021

Related U.S. Application Data

(60) Provisional application No. 62/972,151, filed on Feb. 10, 2020.

(51) Int. Cl.
*H01Q 9/04* (2006.01)
*H01Q 5/15* (2015.01)

(52) U.S. Cl.
CPC ..... *H01Q 9/0414* (2013.01); *H01Q 5/15* (2015.01)

(58) Field of Classification Search
CPC ..... H01Q 9/0414; H01Q 5/15; H01Q 1/48
See application file for complete search history.

(56) References Cited

U.S. PATENT DOCUMENTS 6,181,279 B1 * 1/2001 Van Hoozen ..... H01Q 1/52 343/700 MS
8,462,071 B1 6/2013 Rudish et al.
2015/0123869 A1 5/2015 Bit-Bbik et al.

FOREIGN PATENT DOCUMENTS

CN 104300210 A * 1/2015 ..... H01Q 1/36
KR 200900110175 A 10/2009
KR 101288237 B1 7/2013

OTHER PUBLICATIONS

International Search Report and Written Opinion for Application No. PCT/US2021/017010, dated May 31, 2021, 11 pages.

(Continued)

*Primary Examiner* — Hoang V Nguyen
(74) *Attorney, Agent, or Firm* — Dority & Manning, P.A.

(57) ABSTRACT

An antenna assembly can be configured for RF communications. The antenna assembly can include a ground plane disposed on a substrate. The antenna assembly can include a patch antenna structure spaced apart from the ground plane. The antenna assembly can include one or more grounded posts coupled to and extending from the substrate. The one or more grounded posts can be arranged along at least a portion of a periphery of the patch antenna structure. The patch antenna structure can emit a radiation pattern based at least in part on a transmit signal. The radiation pattern can induce a resultant field in the one or more grounded posts to adjust a characteristic of the radiation pattern.

19 Claims, 9 Drawing Sheets

(56) References Cited

OTHER PUBLICATIONS

Wang et al., "Wideband 60 GHz circularly polarised stacked patch antenna array in low-temperature co-fired ceramic technology", IET Microwaves, Antennas & Propagation, 2015, vol. 9, No. 5, pp. 436-445.

* cited by examiner

PATCH ANTENNA ASSEMBLY WITH GROUNDED POSTS

PRIORITY CLAIM

The present application claims the benefit of priority of U.S. Provisional App. No. 62/972,151, titled "Patch Antenna Assembly with Grounded Posts," having a filing date of Feb. 10, 2020, which is incorporated by reference herein.

FIELD

Example aspects of the present disclosure are directed to antenna systems, such as patch antenna systems.

BACKGROUND

Patch antennas can be used to facilitate communication between two devices. For example, patch antennas can be used to facilitate communication with a satellite. Patch antennas can convert electrical signals into radio frequency (RF) waves that can be transmitted to another device. Patch antennas can also convert RF waves into electrical signals. In some instances, patch antennas can have a nonuniform radiation pattern gain emitted by the patch antennas with respect to propagation direction of the patch antennas.

SUMMARY

Aspects and advantages of embodiments of the present disclosure will be set forth in part in the following description, or may be learned from the description, or may be learned through practice of the embodiments.

One example aspect of the present disclosure is directed to an antenna assembly. The antenna assembly can include a ground plane disposed on a substrate. The antenna assembly can include a patch antenna structure spaced apart from the ground plane. The antenna assembly can include one or more grounded posts coupled to and extending from the substrate. The one or more grounded posts can be arranged along at least a portion of a periphery of the patch antenna structure.

In some embodiments, the patch antenna structure can include a planar portion spaced apart from the ground plane. In some embodiments, the planar portion can be disposed parallel to the ground plane. In some embodiments, the patch antenna structure can include one or more feed legs extending from the planar portion. In some embodiments, the patch antenna structure can have a square planar shape. In some embodiments, the patch antenna structure can be elliptically polarized. In some embodiments, the patch antenna structure can include a second planar portion spaced apart from the planar portion. In some embodiments, the second planar portion can be disposed parallel to the planar portion.

In some embodiments, the patch antenna structure can be configured to produce a receive signal based at least in part on an incident electric field. In some embodiments, the patch antenna structure can be configured to receive a transmit signal. In some embodiments, the patch antenna structure can emit a radiation pattern based at least in part on the transmit signal. In some embodiments, the radiation pattern can induce a resultant field in the one or more grounded posts to adjust a characteristic of the radiation pattern.

In some embodiments, the one or more grounded posts can be arranged along an entire periphery of the patch antenna structure. In some embodiments, the one or more grounded posts can be uniformly spaced along the at least a portion of the periphery of the patch antenna structure. In some embodiments, the one or more grounded posts can be nonuniformly spaced along the at least a portion of the periphery of the patch antenna structure. In some embodiments, the at least a portion of the periphery of the patch antenna structure can include one or more sides. In some embodiments, at least one of the one or more grounded posts can be aligned with a center of at least one of the one or more sides. In some embodiments, the at least a portion of the periphery of the patch antenna structure can include one or more corners. In some embodiments, at least one of the one or more grounded posts is aligned with at least one of the one or more corners.

In some embodiments, the one or more grounded posts can extend a height from the substrate. In some embodiments, the one or more grounded posts can extend a uniform height from the ground plane. In some embodiments, the height can be greater than a spacing between the patch antenna structure and the ground plane. In some embodiments, the height can be equivalent to a spacing between the patch antenna structure and the ground plane. In some embodiments, a shape of the one or more grounded posts can vary along a height of the one or more grounded posts. In some embodiments, the one or more grounded posts can have a hollow cylindrical shape.

In some embodiments, a first grounded post of the one or more grounded posts can coupled to a second grounded post of the one or more grounded posts by a coupling element, the coupling element being distinct from the ground plane. In some embodiments, one or more variable reactive elements can be coupled to at least one of the one or more grounded posts. In some embodiments, the one or more variable reactive elements configured to tune a reactance of the at least one grounded post.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
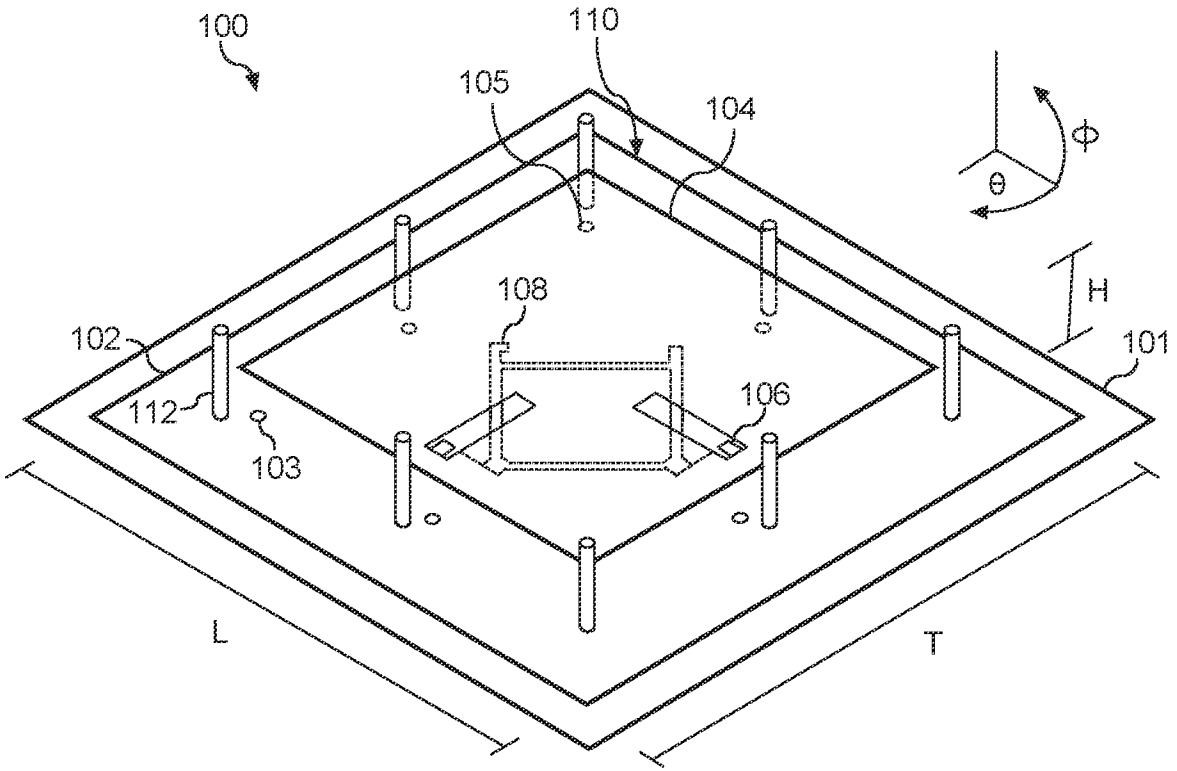
FIG. 1 depicts an example antenna assembly according to example aspects of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to antenna systems, such as patch antenna systems. In particular, example aspects of the present disclosure are directed to antenna assemblies having a patch antenna structure and one or more grounding posts arranged along at least a portion of a periphery of the patch antenna structure.

Antenna systems, such as patch antenna systems, can emit a radiation pattern describing gain of the antenna system with respect to a spatial location around the antenna system. For many antenna systems, the gain can be non-uniform with respect to location, even for locations with a same distance and different angular orientation from the antenna system. For example, a gain at a first angular orientation can be different than a gain at a second angular orientation. In some cases, for example, a patch antenna system can define an elliptically polarized pattern having an axial ratio, wherein the axial ratio is a ratio of a major axis of the elliptically polarized pattern to a minor axis of the elliptically polarized pattern. As another example, an antenna system can define a boresight direction, wherein a maximum gain of the antenna system is in the boresight direction. In some cases, gain of the antenna system in the boresight direction can be significantly greater than gain of the antenna system in directions other than the boresight direction (e.g., opposite the boresight direction).

In some cases, it can be desirable for an antenna system to emit a radiation pattern that has a relatively uniform gain at most or all points within a region at a set distance from the antenna system. For instance, patch antenna systems can be employed on and/or employed to communicate with mobile bodies, such as celestial bodies (e.g., satellites). A mobile body may move and/or a device including an antenna system may move relative to a previous geospatial location. In some cases, a non-uniform gain with respect to angular position can result in inconsistent performance as the mobile body moves. For example, if an antenna assembly is in communication with a satellite, a non-uniform gain can result in inconsistent signal quality between the antenna assembly and the satellite as one or both of the antenna assembly and/or the satellite are moving. Thus, in some cases, it can be desirable to improve uniformity of the gain, such as by decreasing the axial ratio and/or decreasing a difference between gain in a boresight direction and gain in a direction different than the boresight direction. As another example, it can be desirable to increase a width of a region having gain within a margin of a gain of the boresight direction.

According to example aspects of the present disclosure, an antenna assembly can include a patch antenna structure. The patch antenna structure can be spaced apart from a ground plane. The ground plane can be disposed on a substrate. The antenna assembly can include one or more grounded posts. The grounded posts can be coupled to the substrate. The grounded posts can extend from the substrate. For instance, in some embodiments, the grounded posts can extend from the ground plane.

A patch antenna structure can have any suitable shape and/or form in accordance with example implementations of the present disclosure. For instance, a patch antenna structure can be planar. Additionally and/or alternatively, a profile view of a patch antenna structure can resemble one or more geometric shapes. For example, a profile view of a patch antenna structure can resemble one or more rectangles, squares, ellipses, circles, triangles, or any other suitable geometric shape. A patch antenna structure can be composed of any suitable conductive material and/or combination thereof.

In some embodiments, a patch antenna structure can be a low-profile patch antenna structure. For instance, a patch antenna structure can define a patch antenna height along a direction perpendicular to the patch antenna structure and/or a ground plane. For example, a patch antenna height can be a maximum distance between a surface of a patch antenna structure and a reference, such as a ground plane and/or a substrate (e.g., circuit board). In some embodiments, a patch antenna structure can define a patch antenna height that is less than about five centimeters, such as less than about one centimeter.

In some embodiments, a patch antenna structure can include a planar portion and/or one or more feed legs. For instance, one or more feed legs can extend from a planar portion. In some embodiments, a planar portion can be spaced apart from a ground plane. In some embodiments, one or more feed legs can extend from a planar portion in a direction toward a substrate, such as a substrate supporting the patch antenna structure. For instance, in some embodiments, one or more feed legs can be cut from a planar portion and bent towards a substrate. However, any suitable configuration of planar portion and/or feed legs can be employed in accordance with the present disclosure. For instance, patch antenna structures including feed legs that extend away from and/or parallel to a substrate, among other configurations, can be employed in accordance with the present disclosure. In some embodiments, one or more feed legs can include wires, such as wires that are soldered or otherwise attached to a planar portion. In some embodiments, a wire can have a length defined with respect to any suitable element of an antenna assembly, such as, but not limited to, a ground plane, a substrate, a patch antenna structure, an additional circuit element (e.g., a trace element), and/or a feed leg, and/or combination thereof. In some embodiments, a length of a wire from an edge of a substrate supporting an antenna assembly can be about 30 millimeters to about 50 millimeters. A planar portion and/or feed leg can be composed of any suitable conductive material and/or combination thereof.

One or more feed legs can be arranged in any suitable configuration in accordance with the present disclosure. For instance, in one example embodiment, one or more feed legs are arranged in a perpendicular configuration. For example, a first axis defined by a first feed leg can be about perpendicular to a second axis defined by a second feed leg. As another example, one or more feed legs can be arranged in a parallel configuration. For example, a first axis defined by a first feed leg can be about parallel to a second axis defined by a second feed leg. In some embodiments, a first axis and a second axis can lie in a same plane, such as a plane defined by a planar portion of a patch antenna structure.

A planar portion and/or one or more feed legs can have any suitable shape in accordance with example aspects of the present disclosure. For instance, a planar portion can have a thickness, such that a thickness and/or a height of the patch antenna structure does not vary significantly along a planar direction (e.g., a direction defined by a lateral component and a transverse component) of the planar portion. For example, a thickness and/or a height of a planar portion can have less than an about 10% variation along the planar direction, such as less than an about 5% variation, such as less than an about 1% variation. Additionally and/or alternatively, a planar portion can define a length (e.g., in a lateral dimension) and/or a width (e.g., in a transverse dimension), such that a thickness and/or a height of the planar portion is substantially less than the length and/or width. For instance, a ratio of a width and/or a height of a planar portion to a thickness of the planar portion can be greater than about 1, such as greater than about 10, such as greater than about 50. In some embodiments, a thickness of a planar portion and a thickness of one or more feed legs can be about equivalent. As another example, a profile view of a planar portion can resemble one or more geometric shapes. For example, a profile view of a planar portion can resemble one or more rectangles, squares, ellipses, circles, triangles, or any other suitable geometric shapes. For example, a planar portion can have a square planar shape such that a top view of the planar portion resembles a square and a thickness of the planar portion has little to no variation.

In some embodiments, a patch antenna structure can include one or more additional planar portions and/or one or more additional feed legs. For instance, one or more additional planar portions and/or one or more additional feed legs can be spaced apart from a planar portion and/or one or more feed legs. In some embodiments, one or more additional planar portions and/or one or more additional feed legs can be of a similar shape and/or size to a planar portion and one or more feed legs. In some embodiments, a size of one or more additional planar portions and/or one or more additional feed legs can be smaller than a size of a planar portion and one or more feed legs.

A patch antenna structure can be spaced apart from a ground plane in any suitable manner in accordance with example aspects of the present disclosure. For instance, in some embodiments, one or more feed legs can at least partially mechanically support a patch antenna structure at a spacing distance from a ground plane. In some embodiments, one or more spacer elements can support a patch antenna structure apart from a ground plane. In some embodiments, one or more spacer elements can be attached to a patch antenna structure, a planar portion of the patch antenna structure, a ground plane, and/or a substrate (e.g., circuit board). In some embodiments, one or more spacer elements can be attached by one or more holes and/or apertures to a patch antenna structure, a planar portion of the patch antenna structure, a ground plane, and/or a substrate. In some embodiments, one or more spacer elements can be electrically insulating.

A patch antenna structure can be configured to receive and/or produce an RF signal. For example, a patch antenna structure can receive an RF signal (e.g., a transmit signal) produced by one or more RF circuits, such as one or more RF circuits positioned on a substrate and/or a ground plane. For instance, one or more RF circuits can include one or more receiver circuits, one or more transmitter circuits, one or more RF front-end modules, or any other suitable circuits or combinations thereof that may be employed for RF communications. In some embodiments, at least a portion of one or more RF circuits can be spaced apart from a ground plane. For instance, in some embodiments, at least a portion of one or more RF circuits can be disposed between a patch antenna structure and a ground plane. As another example, a patch antenna structure can produce an RF signal (e.g., a receive signal) based at least in part on an incident electric field that is incident with the patch antenna structure. For instance, a patch antenna structure can interact with an incident electric field to produce an RF signal.

An RF signal can be defined for any suitable electrical quality, such as, but not limited to, voltage and/or current. A patch antenna structure can receive any number and/or form of RF signals in accordance with the present disclosure. For example, an RF signal can include a sinusoidal waveform, square waveform, triangle waveform, other waveform (e.g., sawtooth waveform), non-waveform periodic signal (e.g., a signal resembling a tangent function, such as a clipped tangent function), or any other suitable signal.

In some embodiments, an RF signal can have an associated signal frequency. In other words, an RF signal can repeat over time such that a plurality of signal measurements over a first time duration is about equivalent to a plurality of signal measurements over a second time duration, wherein the first and second time duration are related to a signal frequency. For instance, in some embodiments, an RF signal can have a signal frequency within the L-band, or, in other words, from 1 to 2 gigahertz. For instance, in some embodiments, an RF signal can have a signal frequency within a range of about 1525 megahertz to about 1660 megahertz. In some embodiments, an RF signal (e.g., a receive signal) can have a signal frequency within a range of about 1525 megahertz to about 1559 megahertz. In some embodiments, an RF signal (e.g., a transmit signal) can have a signal frequency within a range of about 1626 megahertz to about 1660 megahertz.

A patch antenna structure can emit a radiation pattern based at least in part on an RF signal. For instance, in some embodiments, an RF signal can induce one or more fringing fields at a patch antenna structure. One or more fringing fields can be, for instance, electric fields. Interaction between fringing fields can result in some components (e.g., vector components, such as cartesian vector components) of the fringing fields being canceled out at a patch antenna structure, while other components of the fringing field are not canceled out at the patch antenna structure. For instance, a radiation pattern can include a field corresponding to a sum of one or more noncancelled components of one or more fringing fields. In this way, a radiation pattern produced by a patch antenna structure can be based at least in part on components of one or more fringing fields that are not canceled out. Additionally and/or alternatively, a patch antenna structure can produce an RF signal based at least in part on an incident electric field (e.g., a radiation pattern from another antenna).

In some embodiments, a patch antenna structure can be elliptically polarized. For instance, a radiation pattern emitted by a patch antenna structure can define an ellipsis in a direction of propagation. In other words, a tip of an electric field vector in a direction of propagation from a patch antenna structure can define an elliptical coil. As another example, a shape of a radiation pattern can define an ellipsis. For instance, a cross sectional view of a radiation pattern can define an ellipsis. In other words, a radiation pattern can include an axial ratio, wherein the axial ratio is a ratio of a magnitude of a major axis of the ellipsis to a magnitude of a minor axis of the ellipsis. In embodiments where an axial ratio is about one (i.e., a magnitude of a major axis and a magnitude of a minor axis are about equivalent), a patch antenna structure can be referred to as circularly polarized.

In some embodiments, an axial ratio can vary with respect to propagation direction around a patch antenna structure. For instance, in some embodiments, a patch antenna structure can have a first axial ratio at a first propagation direction and a second axial ratio at a second propagation direction. The first axial ratio and first propagation direction can be distinct from the second axial ratio and second propagation direction. Thus, in some cases, a patch antenna structure can be circularly polarized with respect to a first propagation direction and elliptically polarized with respect to a second propagation direction. Such patch antenna structures can be referred to as either circularly polarized and/or elliptically polarized.

A patch antenna structure can be disposed on a ground plane. A ground plane can be electrically grounded. For instance, a ground plane can have a voltage of about zero volts relative to earth potential. In some embodiments, a ground plane can include one or more holes or apertures. For example, a ground plane can include one or more holes or apertures configured to receive one or more affixing elements. One or more affixing elements can be provided to attach one or more elements to a ground plane, such as, but not limited to, circuit elements, patch antenna structures, spacing structures, device elements, and/or any other suitable elements. Additionally and/or alternatively, one or more affixing elements can be provided to attach a ground plane to a substrate. A ground plane can be composed of any suitable conductive material and/or combination thereof.

In some embodiments, a ground plane can be disposed on a substrate. For example, a substrate can be or include a printed circuit board (PCB), device wall, flexible substrate, prototyping board, or any other suitable substrate. In some embodiments, a substrate can include one or more holes or apertures. For example, a substrate can include one or more holes or apertures configured to receive one or more affixing elements. One or more affixing elements can be provided to attach one or more elements to a substrate, such as, but not limited to, circuit elements, patch antenna structures, spacing structures, device elements, ground planes, and/or any other suitable elements. In some embodiments, one or more affixing elements (e.g., adhesive elements) can be attached to the substrate, such as to a side of the substrate opposite a side to which patch antenna structures and/or grounded posts are affixed. For example, an affixing element can be configured to attach an antenna assembly to a surface, such as, but not limited to, a sidewall, within a casing, or any other suitable surface. Any suitably shaped substrate can be employed in accordance with example aspects of the present disclosure. In some embodiments, the substrate can have a length of about 90 millimeters to about 120 millimeters and a width of about 90 millimeters to about 120 millimeters.

In some embodiments, a substrate can include one or more additional circuit elements in addition to a ground plane. For instance, a substrate can include one or more RF circuit elements configured to provide an RF signal to a patch antenna structure, such as a patch antenna structure disposed on the substrate. Additionally and/or alternatively, a substrate can include one or more additional patch antenna structures and/or additional ground planes. Additionally and/or alternatively, a substrate can include one or more coupling elements.

According to example aspects of the present disclosure, one or more grounded posts can be arranged along at least a portion of a periphery of a patch antenna structure. Any suitable number of grounded posts can be arranged along a periphery of a patch antenna structure. For example, in some embodiments, eight grounded posts can be arranged along a periphery of a patch antenna structure. A grounded post can be composed of any suitable conductive material and/or combination thereof. In one example, a shape (e.g., the periphery) of a patch antenna structure can define one or more corners and/or one or more sides. One or more grounded posts can be disposed proximate to one or more corners and/or one or more sides. For example, one or more grounded posts can be aligned with a side, such as aligned with a center of the side. As another example, one or more grounded posts can be aligned with a corner. For instance, a line defined by a corner and a center of a grounded post can divide an angle of the corner about evenly, such that an angle between a first edge of the corner and the line is about equivalent to an angle between a second edge of the corner and the line. In some embodiments, one or more grounded posts can be arranged along an entire periphery of a patch antenna structure. For instance, at least one grounded post can be disposed proximate each of one or more sides and/or one or more edges of an entire periphery.

In some embodiments, one or more grounded posts can be uniformly spaced along at least a portion of a periphery of a patch antenna structure. For instance, a spacing distance between a first grounded post and a second grounded post in a direction defined by a periphery (e.g., parallel to the periphery, perpendicular to the periphery, concentric with the periphery, etc.) can be about equivalent. In some embodiments, one or more grounded posts can be nonuniformly spaced along at least a portion of a periphery of a patch antenna structure. For instance, a first spacing distance between a first grounded post and a second grounded post in a direction defined by a periphery (e.g., parallel to the periphery, perpendicular to the periphery, concentric with the periphery, etc.) can be different from a second spacing distance between the second grounded post and a third grounded post in the direction defined by the periphery.

One or more grounded posts can extend from a substrate and/or a ground plane. For example, in some embodiments, an extension axis defined by a direction of extension of one or more grounded posts can be perpendicular to a plane defined by a substrate and/or ground plane. In some embodiments, one or more grounded posts can be formed from a ground plane and/or formed from a same material as a ground plane. In some embodiments, one or more grounded posts can be attached to a substrate and/or ground plane.

One or more grounded posts can extend any suitable height from a substrate and/or ground plane in accordance with the present disclosure. For example, in some embodiments, a grounded post can extend a height from a substrate and/or ground plane that is greater than a spacing between a patch antenna structure and the substrate and/or ground plane. In some embodiments, a grounded post can extend a height from a substrate and/or ground plane that is equal to and/or less than a spacing between a patch antenna structure and the substrate and/or ground plane. A height of one or more grounded posts can affect a response of the one or more grounded posts to a radiation pattern. In some embodiments, a height of one or more grounded posts can be selected based on a desired characteristic of a radiation pattern. Additionally and/or alternatively, a height of one or more grounded posts can be selected to fit within one or more constraints, such as one or more constraints (e.g., spatial constraints) of a housing and/or device that includes the one or more grounded posts.

In some embodiments, a height of each of one or more grounded posts in an antenna assembly can be a uniform height, wherein the height for each of the one or more grounded posts is about equivalent. In some embodiments, a first height of a first grounded post can be different from a second height of a second grounded post. In some embodiments, a first height for a first set of grounded posts, such as a set of corner grounded posts (e.g., grounded posts arranged proximate at least one corner of a patch antenna structure) can be different from a second height for a second set of grounded posts, such as a set of side grounded posts (e.g., grounded posts arranged proximate at least one side and/or edge of the patch antenna structure). For instance, in some embodiments, a set of corner grounded posts can have a height of about 6 millimeters to about 8 millimeters and a set of side grounded posts can have a height of about 8 millimeters to about 10 millimeters.

One or more grounded posts can be coupled to a ground plane. For instance, in embodiments wherein one or more grounded posts extend from a ground plane, the one or more grounded posts can be coupled to and/or formed from the ground plane at an intersection of the one or more grounded posts and the ground plane. Additionally and/or alternatively, one or more grounded posts can be coupled to a ground plane by one or more coupling elements. For instance, one or more coupling elements can include, but are not limited to, wires, capacitors, resistors, inductors, transistors, diodes, dielectrics, or any other suitable coupling elements. For instance, in some embodiments, one or more coupling elements can include one or more variable reactive elements configured to tune a reactance of a grounded post. Additionally and/or alternatively, one or more coupling elements can couple a first grounded post to a second grounded post. For instance, one or more coupling elements can couple a first grounded post to a second grounded post in addition to a coupling provided by a ground plane.

One or more grounded posts can have any suitable shape in accordance with the present disclosure. For instance, one or more grounded posts can have a cross-sectional profile resembling one or more geometric shapes, such as, but not limited to, one or more rectangles, squares, ellipses, circles, triangles, or any other suitable geometric shapes. In some embodiments, a shape of a grounded post can include one or more solid portions and/or one or more hollow portions. For instance, in some embodiments, a shape of a grounded post can be a hollow cylindrical shape, such that the shape of the grounded post resembles a cylinder and is hollow.

In some embodiments, a shape of one or more grounded posts can vary along a height of the one or more grounded posts. For example, a grounded post can transition from a first shape (e.g., cross-sectional shape) to a second shape along a height of the grounded post. In other words, a first portion of a grounded post can have a first cross-sectional shape and a second portion of a grounded post can have a second cross-sectional shape, the second cross-sectional shape being distinct from the first cross-sectional shape. As another example, a grounded post can comprise a "bent" shape, such as a bent cylinder. For example, a bent shape can include a first cross-section having a similar profile to a second cross-section, wherein the second cross-section is offset with respect to the first cross-section. In some embodiments, a variable or bent shape along a height of a grounded post can have different electrical responses at different positions along the height, which can affect azimuthal radiation patterns from an antenna assembly.

According to example aspects of the present disclosure, an electric field, such as a radiation pattern, can induce a resultant field in a grounded post. A grounded post can emit a resultant field. For instance, a resultant field can be induced by interaction between a grounded post and an electrical field of the radiation pattern, such as a fringing field, and/or an overall product field of one or more fringing fields in a localized region, such as a region proximate the grounded post. For example, a radiation pattern can induce a localized charge region in a portion of a grounded post, and a charge disparity between the localized charge region and a ground (e.g., a ground plane) coupled to the grounded post can induce a resultant field in the grounded post, which can then be emitted by the grounded post.

According to example aspects of the present disclosure, a resultant field can adjust a characteristic of the radiation pattern. For instance, a result field can include one or more resultant field components (e.g., vector components). One or more resultant field components can interact with a radiation pattern, such as one or more radiation field components (e.g., vector components) of the radiation pattern, to produce a net radiation pattern based on the radiation pattern and the resultant field. An antenna assembly can thus radiate a net radiation pattern, which can include a resultant combination of a radiation pattern from a patch antenna assembly and one or more resultant fields from one or more grounded posts.

In some embodiments, an antenna assembly according to example aspects of the present disclosure can be disposed within a housing. For instance, a housing can protect an antenna assembly from an environment. A housing can be configured to house, for instance, a patch antenna structure, a ground plane, a substrate, one or more grounded posts, and/or one or more additional circuit elements (e.g., RF circuits). Example embodiments of the present disclosure are contemplated for wireless communication with a celestial body, such as a satellite. However, in some embodiments, an antenna assembly according to example aspects of the present disclosure can be housed in and used for communication in and/or with an electronic device, such as, but not limited to, a router, mobile device, smart device, desktop computer, or other suitable electronic device. Properties of certain aspects of antenna assemblies according to example aspects of the present disclosure can be selected to accommodate a housing of the antenna assemblies.

In some embodiments, one or more additional elements can be positioned proximate a patch antenna structure. For example, in some embodiments, one or more directive elements can be positioned above a patch antenna structure. For instance, one or more directive elements can be spaced from a ground plane by a distance, the distance being greater than a height of a patch antenna structure. A directive element can direct a radiation pattern from a patch antenna structure. For instance, a directive element can include, but is not limited to, a director, reflector, waveguide, or any other suitable directive element.

Aspects of the present disclosure can provide for a number of technical effects and benefits. For instance, example embodiments according to the present disclosure can have improved circularly polarized gain. In some embodiments, circularly polarized gain at angular positions around an antenna assembly that are not within boresight of the antenna assembly, i.e., a direction of maximum gain, can especially be improved. Additionally and/or alternatively, in some embodiments, circularly polarized gain can be improved over a range of frequencies. For instance, in some embodiments, aspects of the present disclosure can provide for an increased angular coverage range of an antenna assembly.

Improved angular coverage range according to example aspects of the present disclosure can be beneficial in a number of applications. For instance, in embodiments where an antenna assembly according to example aspects of the present disclosure is used in communication with a mobile body, especially a celestial body (e.g., a satellite) increased circularly polarized gain at angles not within boresight of an antenna assembly can allow for improved communication quality with the mobile body if the mobile body moves relative to the antenna assembly over time. For example, a mobile body may move and/or a device including an antenna assembly may move relative to a previous geospatial location. In some embodiments, the improved angular coverage range can allow for improved communication while either or both of the antenna assembly and/or mobile body are moving. For instance, if an antenna assembly is in communication with a satellite, improved angular coverage range can allow for improved signal quality between the antenna assembly and the satellite as one or both of the antenna assembly and/or the satellite are moving.

As used herein, use of the term "about" in conjunction with a numerical value is intended to refer to within twenty percent (20%) of the stated numerical value.

Referring now to the FIGS., example embodiments according to example aspects of the present disclosure are discussed. FIG. 1 illustrates an example antenna assembly 100 according to example aspects of the present disclosure. The antenna assembly 100 includes a ground plane 102. Ground plane 102 can be electrically grounded. For instance, ground plane 102 can have a voltage of about zero volts relative to earth potential. In some embodiments, ground plane 102 can include one or more holes or apertures 103. For example, one or more holes or apertures 103 can be configured to receive one or more affixing elements (not illustrated). The one or more affixing elements can be provided to attach one or more elements to ground plane 102, such as, but not limited to, circuit elements, patch antenna structures, spacing structures, device elements, and/or any other suitable elements. Ground plane 102 can be composed of any suitable conductive material and/or combination thereof.

In some embodiments, ground plane 102 can be disposed on a substrate 101. For example, substrate 101 can be or include a printed circuit board (PCB), device wall, flexible substrate, prototyping board, or any other suitable substrate. In some embodiments, substrate 101 can include one or more holes or apertures (not illustrated). For example, substrate 101 can include one or more holes or apertures configured to receive one or more affixing elements. One or more affixing elements can be provided to attach one or more elements to substrate 101, such as, but not limited to, circuit elements, patch antenna structures (e.g., patch antenna structure 110 and/or planar portion 104), spacing structures, device elements, ground planes (e.g., ground plane 102), and/or any other suitable elements. Substrate 101 can define a lateral dimension, illustrated by the dimension L in FIG. 1, and a transverse dimension, illustrated by the dimension T in FIG. 1. In some embodiments, the substrate can have a length (e.g., along the lateral dimension) of about 90 millimeters to about 120 millimeters and a width (e.g., along the transverse dimension) of about 90 millimeters to about 120 millimeters. In some embodiments, at least one affixing element (not depicted) can be attached to substrate 101. For instance, the at least one affixing element can be attached to substrate 101 on a side opposite a side to which ground plane 102, patch antenna structure 110, and/or grounded posts 112 are affixed. For example, the affixing element can be configured to adhere substrate 101 and/or antenna assembly 100 to a surface, such as, but not limited to, a sidewall, within a casing, or any other suitable surface.

Antenna assembly 100 can include a patch antenna structure 110. Patch antenna structure 110 can include at least planar portion 104 and one or more feed legs 106. Planar portion 104 can be spaced apart from ground plane 102. For instance, planar portion 104 can be spaced apart from ground plane 102 in a height dimension H. In some embodiments, planar portion 104 can be spaced from ground plane 102 by a spacing that is less than about five centimeters, such as less than about one centimeter. In some embodiments, planar portion 104 can include one or more holes and/or apertures 105.

In some embodiments, one or more feed legs 106 can extend from planar portion 104. In some embodiments, planar portion 104 can be spaced apart from ground plane 102. In some embodiments, one or more feed legs 106 can extend from planar portion 104 in a direction toward substrate 101. For instance, in some embodiments, one or more feed legs 106 can be cut from planar portion 104 and bent towards substrate 101. However, any suitable configuration of patch antenna structure 110 can be employed in accordance with the present disclosure. For instance, feed legs 106 that extend away from and/or parallel to patch antenna structure 110, among other configurations, can be employed in accordance with the present disclosure. In some embodiments, one or more feed legs 106 can include wires, such as wires that are soldered or otherwise attached to planar portion 104. In some embodiments, a wire can have a length defined with respect to any suitable element of antenna assembly 100, such as, but not limited to, ground plane 102, substrate 101, patch antenna structure 110 (e.g. planar portion 104 and/or feed legs 106), and/or combination thereof. In some embodiments, a length of a wire from an edge of substrate 101 can be about 30 millimeters to about 50 millimeters. Planar portion 104 and/or feed legs 106 can be composed of any suitable conductive material and/or combination thereof. In some embodiments, one or more trace elements 108 can be coupled to one or more feed legs 106. For instance, one or more trace elements 108 can be configured to provide and/or receive an RF signal at one or more feed legs 106.

One or more feed legs 106 can be arranged in any suitable configuration in accordance with the present disclosure. For instance, as illustrated in FIG. 1, one or more feed legs 106 are arranged in a perpendicular configuration. For example, a first axis defined by a first feed leg 106 can be about perpendicular to a second axis defined by a second feed leg 106. As another example, one or more feed legs 106 can be arranged in a parallel configuration. For example, a first axis defined by a first feed leg 106 can be about parallel to a second axis defined by a second feed leg 106. In some embodiments, a first axis and a second axis can lie in a same plane.

Patch antenna structure 110, including planar portion 104 and/or feed legs 106, can have any suitable shape in accordance with the present disclosure. For instance, planar portion 104 can have a thickness, such that a thickness and/or a height of planar portion 104 does not vary significantly along a planar direction (e.g., a direction described by lateral dimension L and/or transverse dimension T) of planar portion 104. For example, a thickness and/or a height of planar portion 104 can have less than an about 10% variation along the planar direction, such as less than an about 5% variation, such as less than an about 1% variation. Additionally and/or alternatively, planar portion 104 can define a length and/or a width, such that a thickness and/or a height of planar portion 104 is substantially less than the length and/or width. For instance, a ratio of a width and/or a height of planar portion 104 to a thickness of planar portion 104 can be greater than about 1, such as greater than about 10, such as greater than about 50. In some embodiments, a thickness of planar portion 104 and a thickness of one or more feed legs 106 can be about equivalent. As another example, a profile view of planar portion 104 can resemble one or more geometric shapes. For example, a profile view of planar portion 104 can resemble one or more rectangles, squares, ellipses, circles, triangles, or any other suitable geometric shapes. For example, planar portion 104 can have a square planar shape such that a top view of planar portion 104 resembles a square and a thickness of planar portion 104 has little to no variation, such as little to no variation along a lateral dimension L and/or transverse direction T.

Planar portion 104 can be spaced apart from ground plane 102 in any suitable manner in accordance with example aspects of the present disclosure. For instance, in some embodiments, one or more feed legs 106 can at least partially mechanically support planar portion 104 at a spacing distance from ground plane 102. In some embodiments, one or more spacer elements (not illustrated) can support planar portion 104 apart from ground plane 102. In some embodiments, one or more spacer elements can be attached to planar portion 104 and/or ground plane 102. In some embodiments, one or more spacer elements can be attached by one or more holes and/or apertures 105 to planar portion 104. In some embodiments, one or more spacer elements can be electrically insulating.

Antenna assembly 100 can be configured to receive and/or produce an RF signal. For example, one or more feed legs 106 can receive an RF signal (e.g., a transmit signal) from one or more RF circuit elements (not illustrated). For example, one or more RF circuit elements can be disposed on substrate 101 and/or a separate substrate (not illustrated) and one or more transmission lines from the one or more RF circuit elements can be coupled to the one or more feed legs 106. As another example, at least planar portion 104 can produce an RF signal (e.g., a receive signal) based at least in part on an incident electric field that is incident with the planar portion 104. For instance, at least planar portion 104 can interact with an incident electric field to produce an RF signal at one or more feed legs 106.

An RF signal can be defined for any suitable electrical quality, such as, but not limited to, voltage and/or current. One or more feed legs 106 can receive any number and/or form of RF signals in accordance with the present disclosure. For example, an RF signal can include a sinusoidal waveform, square waveform, triangle waveform, other waveform (e.g., sawtooth waveform), non-waveform periodic signal (e.g., a signal resembling a tangent function, such as a clipped tangent function), or any other suitable signal.

Antenna assembly 100 can emit a radiation pattern based at least in part on an RF signal. For instance, in some embodiments, an RF signal can induce one or more fringing fields at planar portion 104. One or more fringing fields can be, for instance, electric fields. Interaction between fringing fields can result in some components (e.g., vector components, such as cartesian vector components) of the fringing fields being canceled out at a patch antenna structure, while other components of the fringing field are not canceled out at the patch antenna structure. For instance, a radiation pattern can include a field corresponding to a sum of one or more noncancelled components of one or more fringing fields. In this way, a radiation pattern produced by a patch antenna structure can be based at least in part on components of one or more fringing fields that are not canceled out. Additionally and/or alternatively, a patch antenna structure can produce an RF signal based at least in part on an incident electric field (e.g., a radiation pattern from another antenna).

In some embodiments, antenna assembly 100 can be elliptically polarized. For instance, a radiation pattern emitted by antenna assembly 100 can define an ellipsis in a direction of propagation. In other words, a tip of an electric field vector in a direction of propagation from antenna assembly 100 can define an elliptical coil. As another example, a shape of a radiation pattern can define an ellipsis. For instance, a cross sectional view of a radiation pattern can define an ellipsis. In other words, a radiation pattern can include an axial ratio, wherein the axial ratio is a ratio of a magnitude of a major axis of the ellipsis to a magnitude of a minor axis of the ellipsis. In embodiments where an axial ratio is about one (i.e., a magnitude of a major axis and a magnitude of a minor axis are about equivalent), antenna assembly 100 can be referred to as circularly polarized.

In some embodiments, an axial ratio can vary with respect to propagation direction around antenna assembly 100. For instance, propagation direction can be along one or more angular dimensions, such a latitudinal dimension $\ddot{\gamma}$ and or longitudinal dimension $\ddot{\gamma}$. For instance, in some embodiments, antenna assembly 100 can have a first axial ratio at a first propagation direction and a second axial ratio at a second propagation direction. The first axial ratio and first propagation direction can be distinct from the second axial ratio and second propagation direction. Thus, in some cases, antenna assembly 100 can be circularly polarized with respect to a first propagation direction and elliptically polarized with respect to a second propagation direction.

Antenna assembly 100 can include one or more grounded posts 112 disposed on ground plane 102. Any suitable number of grounded posts 112 can be disposed on ground plane 102. For example, as depicted in FIG. 1, eight grounded posts 112 can be disposed on ground plane 102. One or more grounded posts 112 can be composed of any suitable conductive material and/or combination thereof. One or more grounded posts 112 can be disposed proximate to one or more corners and/or one or more sides of planar portion 104. For example, one or more grounded posts 112 can be aligned with a side of planar portion 104, such as aligned with a center of the side of planar portion 104. As another example, one or more grounded posts 112 can be aligned with a corner of planar portion 104. For instance, a line defined by a corner and a center of a grounded post 112 can divide an angle of the corner of planar portion 104 about evenly, such that an angle between a first edge of the corner and the line is about equivalent to an angle between a second edge of the corner and the line. In some embodiments, one or more grounded posts 112 can be arranged along an entire periphery of planar portion 104. For instance, at least one grounded post 112 can be disposed proximate each of one or more sides and/or one or more edges of an entire periphery of planar portion 104.

In some embodiments, one or more grounded posts 112 can be uniformly spaced along at least a portion of a periphery of planar portion 104. For instance, a spacing distance between a first grounded post 112 and a second grounded post 112 in a direction defined by a periphery of planar portion 104 (e.g., parallel to the periphery, perpendicular to the periphery, concentric with the periphery, etc.) can be about equivalent. In some embodiments, one or more grounded posts 112 can be nonuniformly spaced along at least a portion of a periphery of planar portion 104. For instance, a first spacing distance between a first grounded post 112 and a second grounded post 112 in a direction defined by a periphery of planar portion 104 (e.g., parallel to the periphery, perpendicular to the periphery, concentric with the periphery, etc.) can be different from a second spacing distance between the second grounded post 112 and a third grounded post 112 in the direction defined by the periphery.

One or more grounded posts 112 can extend from ground plane 102 and/or substrate 101. For example, in some embodiments, an extension axis defined by a direction of extension of one or more grounded posts 112 can be perpendicular to a plane defined by ground plane 102 and/or substrate 101. In some embodiments, one or more grounded posts 112 can be formed from ground plane 102 and/or substrate 101 and/or formed from a same material as ground plane 102 and/or substrate 101. In some embodiments, one or more grounded posts 112 can be attached to ground plane 102 and/or substrate 101.

One or more grounded posts 112 can extend any suitable height from ground plane 102 and/or substrate 101 in accordance with the present disclosure. For example, in some embodiments, one or more grounded posts 112 can extend a height from ground plane 102 and/or substrate 101 that is greater than a spacing between planar portion 104 and ground plane 102 and/or substrate 101. In some embodiments, one or more grounded posts 112 can extend a height from ground plane 102 and/or substrate 101 that is equal to and/or less than a spacing between planar portion 104 and ground plane 102 and/or substrate 101. A height of one or more grounded posts 112 can affect a response of the one or more grounded posts 112 to a radiation pattern. In some embodiments, a height of one or more grounded posts 112 can be selected based on a desired characteristic of a radiation pattern. Additionally and/or alternatively, a height of one or more grounded posts 112 can be selected to fit within one or more constraints. In some embodiments, a height of each of one or more grounded posts 112 in an antenna assembly can be a uniform height, such the uniform height for each of the grounded posts 112 is about equivalent. In some embodiments, a first height of a first grounded post 112 can be different from a second height of a second grounded post 112. In some embodiments, a first height for a first set of grounded posts 112, such as a set of corner grounded posts (e.g., grounded posts arranged proximate at least one corner of patch antenna structure 110) can be different from a second height for a second set of grounded posts 112, such as a set of side grounded posts 112 (e.g., grounded posts arranged proximate at least one side and/or edge of patch antenna structure 110). For instance, in some embodiments, a set of corner grounded posts 112 can have a height of about 6 millimeters to about 8 millimeters and a set of side grounded posts 112 can have a height of about 8 millimeters to about 10 millimeters.

One or more grounded posts 112 can be coupled to ground plane 102 and/or substrate 101. For instance, in embodiments wherein one or more grounded posts 112 extend from ground plane 102 and/or substrate 101, the one or more grounded posts 112 can be coupled to and/or formed from the ground plane 102 and/or substrate 101 at an intersection of the one or more grounded posts 112 and the ground plane 102 and/or substrate 101. Additionally and/or alternatively, one or more grounded posts 112 can be coupled to ground plane 102 and/or substrate 101 by one or more coupling elements. For instance, one or more coupling elements can include, but are not limited to, wires, capacitors, resistors, inductors, transistors, diodes, dielectrics, or any other suitable coupling elements. For instance, in some embodiments, one or more coupling elements can include one or more variable reactive elements configured to tune a reactance of one or more grounded posts 112.

One or more grounded posts 112 can have any suitable shape in accordance with the present disclosure. For instance, one or more grounded posts 112 can have a cross-sectional profile resembling one or more geometric shapes, such as, but not limited to, one or more rectangles, squares, ellipses, circles, triangles, or any other suitable geometric shapes. In some embodiments, a shape of one or more grounded posts 112 can include one or more solid portions and/or one or more hollow portions. For instance, in some embodiments, a shape of grounded posts 112 can be a hollow cylindrical shape, such that the shape of grounded posts 112 resembles a cylinder and is hollow.

In some embodiments, a shape of one or more grounded posts 112 can vary along a height of the one or more grounded posts 112. For example, one or more grounded posts 112 can transition from a first shape (e.g., cross-sectional shape) to a second shape along a height of the grounded post 112. In other words, a first portion of one or more grounded posts 112 can have a first cross-sectional shape and a second portion of one or more grounded posts 112 can have a second cross-sectional shape, the second cross-sectional shape being distinct from the first cross-sectional shape. As another example, one or more grounded posts 112 can comprise a "bent" shape, such as a bent cylinder. For example, a bent shape can include a first cross-section having a similar profile to a second cross-section, wherein the second cross-section is offset with respect to the first cross-section. In some embodiments, a variable or bent shape along a height of one or more grounded posts 112 can have different electrical responses at different positions along the height, which can affect azimuthal radiation patterns (e.g., gain along the angular dimension indicated by $\theta$ and/or $\varphi$) from antenna assembly 100.

According to example aspects of the present disclosure, an electric field, such as a radiation pattern, can induce a resultant field in one or more grounded posts 112. One or more grounded posts 112 can emit a resultant field. For instance, a resultant field can be induced by interaction between one or more grounded posts 112 and an electrical field of the radiation pattern, such as a fringing field, and/or an overall product field of one or more fringing fields in a localized region, such as a region proximate the grounded post 112. For example, a radiation pattern can induce a localized charge region in a portion of one or more grounded posts 112, and a charge disparity between the localized charge region and a ground (e.g., ground plane 102 and/or substrate 101) coupled to the grounded post 112 can induce a resultant field in the grounded post, which can then be emitted by the grounded post 112.

Figure 2:
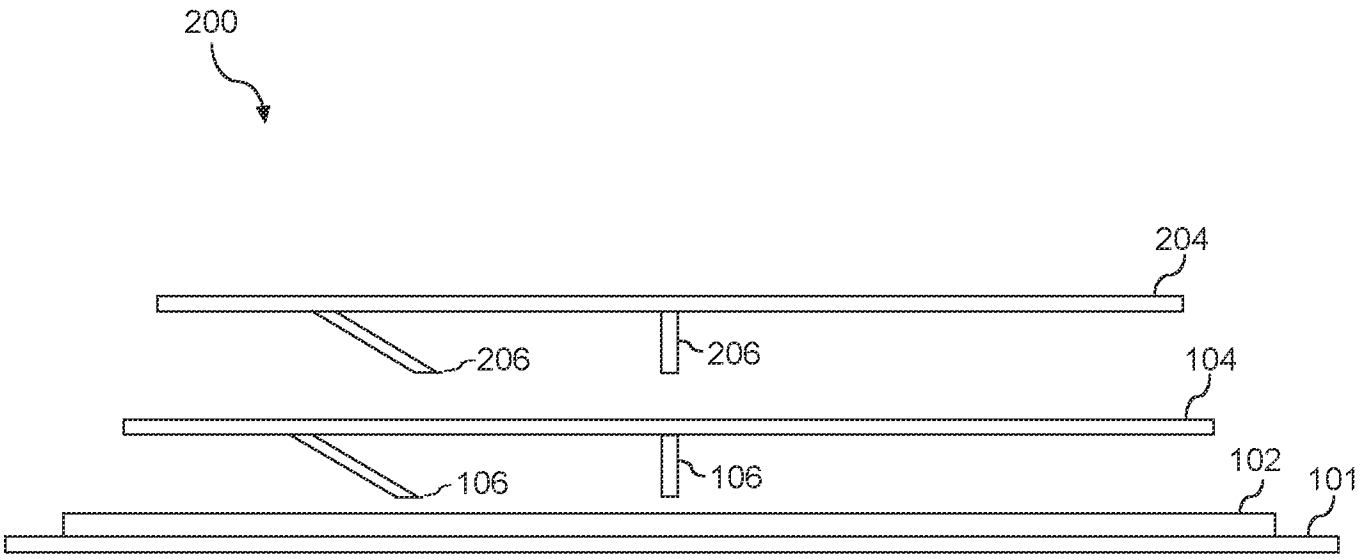
FIG. 2 depicts a patch antenna structure according to example aspects of the present disclosure.

FIG. 2 illustrates an example patch antenna structure 200 according to example embodiments of the present disclosure. Patch antenna structure 200 can include one or more antenna assembly components, such as any components discussed above with respect to FIG. 1. For instance, patch antenna structure 200 can include substrate 101, ground plane 102, planar portion 104, and/or one or more feed legs 106. One or more grounded posts 112 have been omitted from the illustration of FIG. 2 for the purposes of clarity. However, one or more grounded posts 112 can be disposed on substrate 101 and/or ground plane 102 as discussed above with respect to FIG. 1.

Patch antenna structure 200 can include a second planar portion 204. Second planar portion 204 can be spaced apart from planar portion 104. For instance, second planar portion 204 can be spaced farther from ground plane 102 than planar portion 104 is spaced from ground plane 102. Second planar portion 204 can include one or more second feed legs 206 and/or second trace elements (not illustrated). Second planar portion 204 and/or second feed legs 206 can have any suitable shape and/or configuration in accordance with example embodiments of the present disclosure. For instance, in some embodiments, second planar portion 204 and/or second feed legs 206 can have a same shape and/or configuration as planar portion 104 and/or feed legs 106. In some embodiments, a size of second planar portion 204 can be less than a size of planar portion 104.

Patch antenna structure 200 can be configured to receive and/or produce an RF signal. For example, one or more feed legs 106 and/or second feed legs 206 can receive an RF signal (e.g., a transmit signal) from one or more RF circuit elements (not illustrated). For example, one or more RF circuit elements can be disposed on substrate 101 and/or a separate substrate (not illustrated) and one or more transmission lines from the one or more RF circuit elements can be coupled to the one or more feed legs 106 and/or second feed legs 206. As another example, at least planar portion 104 and/or second planar portion 204 can produce an RF signal (e.g., a receive signal) based at least in part on an incident electric field that is incident with the planar portion 104 and/or second planar portion 204. For instance, at least planar portion 104 and/or second planar portion 204 can interact with an incident electric field to produce an RF signal at one or more feed legs 106 and/or second feed legs 206.

An RF signal can be defined for any suitable electrical quality, such as, but not limited to, voltage and/or current. One or more feed legs 106 and/or second feed legs 206 can receive any number and/or form of RF signals in accordance with the present disclosure. For example, an RF signal can include a sinusoidal waveform, square waveform, triangle waveform, other waveform (e.g., sawtooth waveform), non-waveform periodic signal (e.g., a signal resembling a tangent function, such as a clipped tangent function), or any other suitable signal.

Figure 3:
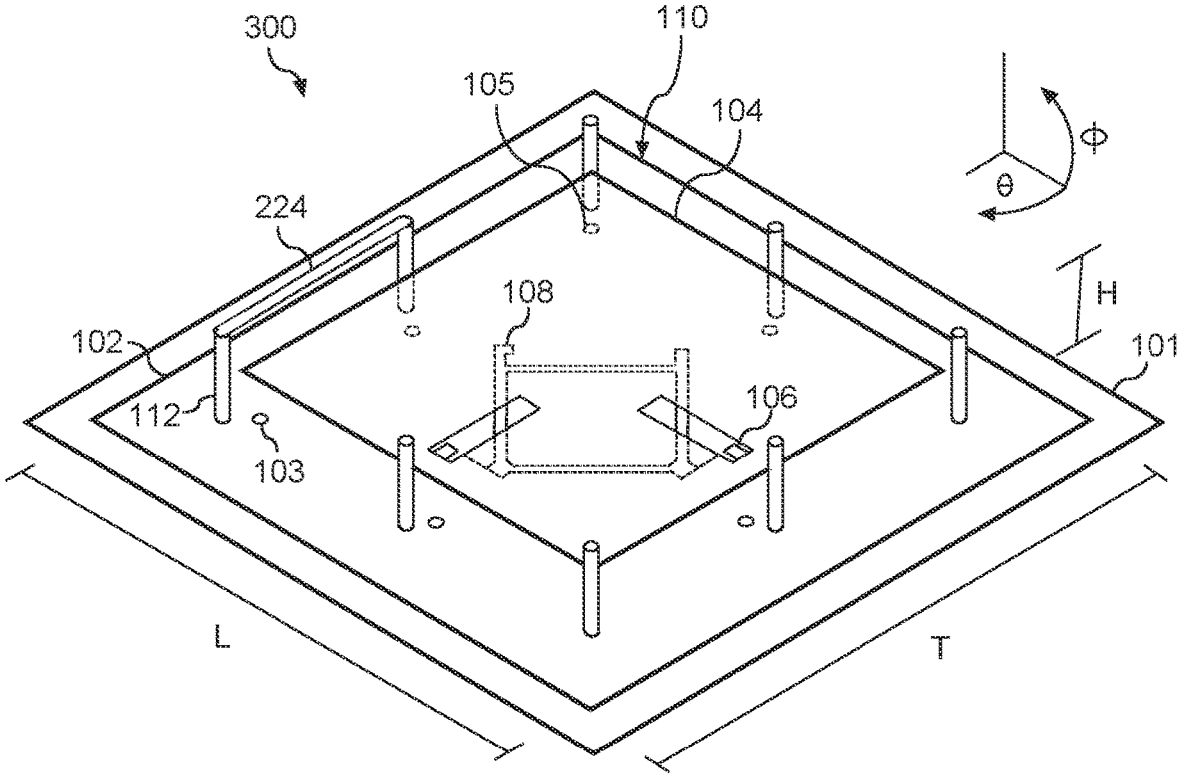
FIG. 3 depicts an example antenna assembly according to example aspects of the present disclosure.

FIG. 3 illustrates an example antenna assembly 300 according to example embodiments of the present disclosure. Antenna assembly 300 can include one or more antenna assembly components, such as any components discussed above with respect to FIGS. 1-2. For instance, antenna assembly 300 can include substrate 101, ground plane 102, planar portion 104, one or more feed legs 106, and/or one or more grounded posts 112.

Antenna assembly 300 can include one or more coupling elements 224. One or more coupling elements 224 can be configured to couple two or more grounded posts 112 by a coupling other than a coupling provided by ground plane 102. For instance, one or more coupling elements 224 can create an electrical connection between two or more grounded posts 112. One or more coupling elements 224 can include, but are not limited to, wires, capacitors, resistors, inductors, transistors, diodes, dielectrics, or any other suitable coupling elements. For instance, in some embodiments, one or more coupling elements 224 can include one or more variable reactive elements configured to tune a reactance of the two or more coupled grounded posts 112. One or more coupling elements 224 can affect a radiation pattern emitted by patch antenna structure 110.

Figure 4:
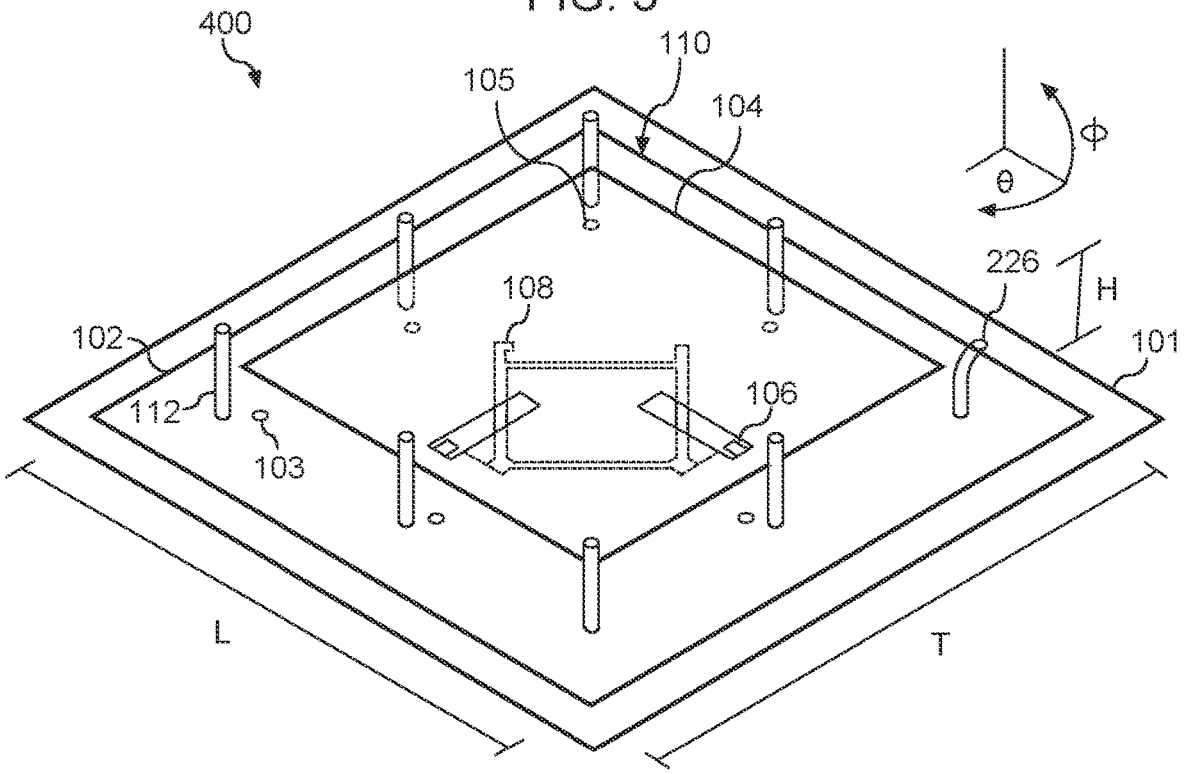
FIG. 4 depicts an example antenna assembly according to example aspects of the present disclosure.

FIG. 4 illustrates an example antenna assembly 400 according to example embodiments of the present disclosure. Antenna assembly 400 can include one or more antenna assembly components, such as any components discussed above with respect to FIGS. 1-3. For instance, antenna assembly 400 can include substrate 101, ground plane 102, planar portion 104, one or more feed legs 106, and/or one or more grounded posts 112.

Antenna assembly 400 can include one or more bent grounded posts 226. As illustrated, one or more bent grounded posts 226 can include a bent cylindrical shape. For example, a bent cylindrical shape can include a first cross-section having a similar profile (e.g., a circular cross-section) to a second cross-section, wherein the second cross-section is offset with respect to the first cross-section. In some embodiments, bent grounded post 226 can have different electrical responses at different positions along the height, which can affect azimuthal radiation patterns from patch antenna structure 110.

Figure 5:
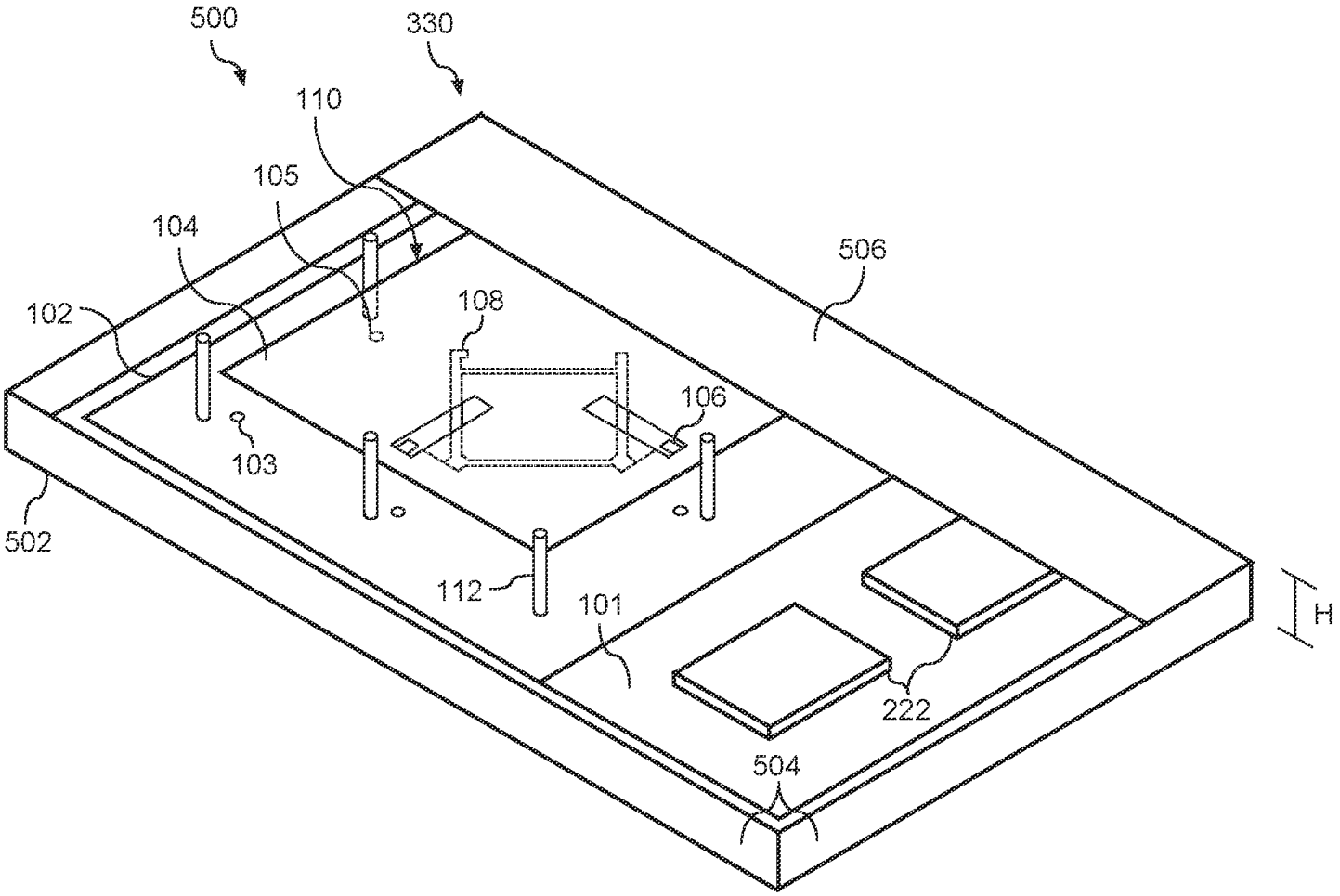
FIG. 5 depicts an example antenna assembly according to example aspects of the present disclosure.

FIG. 5 illustrates an example antenna assembly 500 according to example aspects of the present disclosure. Antenna assembly 500 can include one or more patch antenna components as discussed above with reference to FIGS. 1-4. Antenna assembly 400 can be disposed within housing 330. For instance, housing 330 can protect antenna assembly 300 from an environment. Housing 330 can be configured to house, for instance, patch antenna structure 110 (e.g., planar portion 104 and/or one or more feed legs 106), ground plane 102, substrate 101, one or more grounded posts 112, and/or one or more additional circuit elements 222.

Housing 330 can have any suitable shape in accordance with the present disclosure. For instance, in some embodiments, housing can be substantially the same shape as substrate 101. As illustrated, housing 330 includes at least a base 502, one or more sidewalls 504, and/or a cover 506. Cover 506 is illustrated as extending over only a portion of base 502 and/or one or more sidewalls 504 for the purpose of illustration. However, cover 506 can also extend over the entire base 502 and/or sidewalls 504.

Antenna assembly 500 can include one or more additional circuit elements 222. For instance, additional circuit elements 222 can include one or more RF circuit elements configured to provide an RF signal to patch antenna structure 110, such as one or more feed legs 106 and/or planar portion 104. Additionally and/or alternatively, additional circuit elements 222 can include one or more additional patch antenna structures and/or additional ground planes. In some embodiments, one or more additional circuit elements 222 can be disposed on substrate 101 and/or housed in housing 330. In some embodiments, one or more additional circuit elements 222 can be disposed outside housing 330, such as on a separate substrate. In some embodiments, one or more feed lines (not illustrated) can connect additional circuit elements 222 to patch antenna structure 110, such as to one or more feed legs 106 and/or one or more trace elements 108.

Housing 330 is contemplated as a standalone housing, such as a housing configured to house antenna assembly 500 in a standalone communication device, such as a communication device configured for wireless communication with celestial bodies (e.g., a satellite). However, in some embodiments, housing 330 can be included in and/or be at least a portion of an electronic device, such as, but not limited to, a router, mobile device, smart device, desktop computer, or other suitable electronic device. Properties of certain aspects of antenna assembly 500 can be selected to accommodate housing 330. For instance, properties such as, but not limited to, height of grounded posts 112, spacing between planar portion 104 and ground plane 102, position of additional circuit elements 222, arrangement of feed legs 106, or any other suitable characteristic can be selected based at least in part on housing 330. Additionally and/or alternatively, the properties can be selected based on at least one desired radiation pattern characteristic.

Figure 6:
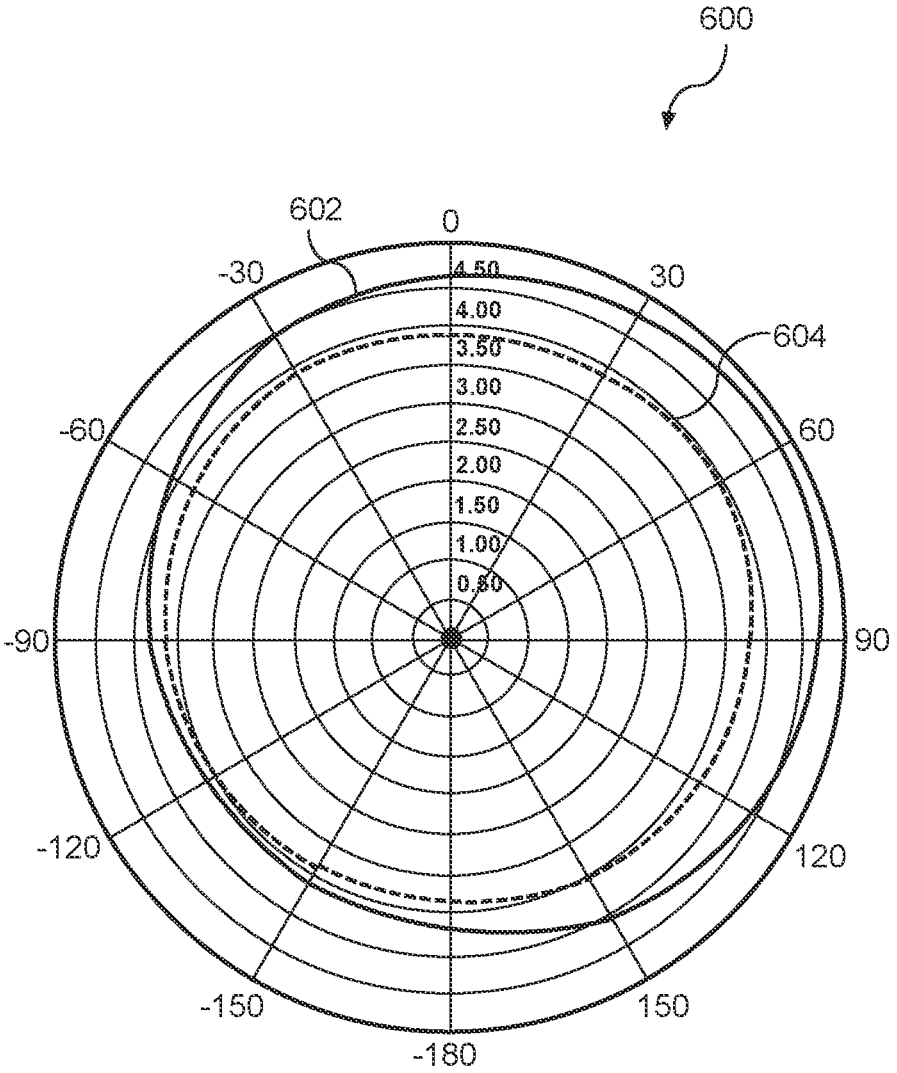
FIG. 6 depicts an example radiation pattern for an example antenna assembly according to example aspects of the present disclosure.

FIG. 6 depicts a plot 600 of an example radiation pattern for an example antenna assembly (e.g., such as, but not necessarily, any of antenna assemblies 100, 200, 300, 400, 500 of FIGS. 1-5) according to example aspects of the present disclosure. In particular, FIG. 6 depicts a two-dimensional cross-section of a radiation pattern at a certain angular position. For example, the cross-section can be taken with respect to a lateral dimension, such as illustrated by the dimension φ in FIG. 1. As another example, the cross-section can be taken with respect to a longitudinal dimension, such as illustrated by the dimension θ in FIG. 1.

FIG. 6 depicts a plot of gain as a function of angular position, wherein a farther distance from the center of the plot at a position is generally indicative of a stronger gain at that position. In some cases, the gain of a radiation pattern can differ at an angular position with respect to frequency. For example, curve 602 depicts gain of a radiation pattern for a signal at a first frequency, and curve 604 depicts gain of a radiation pattern for a signal at a second frequency. As illustrated in FIG. 6, a radiation pattern for an antenna assembly according to example aspects of the present disclosure can have relatively uniform gain with respect to angular position.

Figure 7:
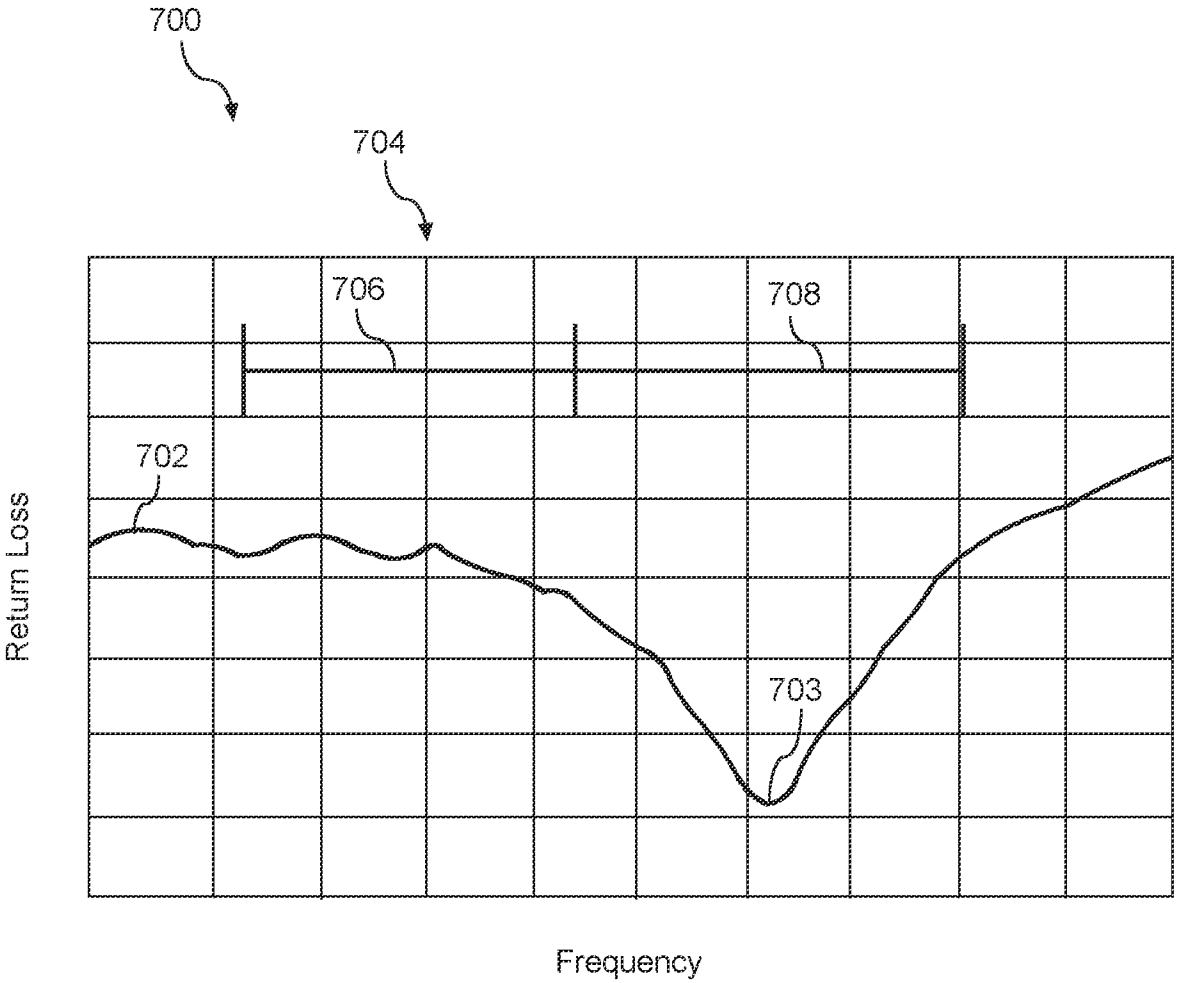
FIG. 7 depicts a plot of return loss for an example antenna assembly according to example aspects of the present disclosure.

FIG. 7 depicts a plot 700 of return loss 702 for an example antenna assembly (e.g., such as, but not necessarily, any of antenna assemblies 100, 200, 300, 400, 500 of FIGS. 1-5) according to example aspects of the present disclosure. In particular, FIG. 7 depicts return loss 702 over a band of frequencies, wherein a lower value along the ordinate is generally associated with a greater return loss. For example, an operation band 704 can span a plurality of frequencies. For example, operation band 704 can span the L-band frequencies, in particular from 1 gigahertz to 2 gigahertz. As another example, operation band 704 can span a subset of the L-band frequencies, such as from about 1550 megahertz to about 1660 megahertz. In some embodiments, operation band 704 can be divided into a transmit band 706 and receive band 708. For example, receive band 708 can be in a frequency range having lower return loss, such as including minimum 703.

Figure 8:
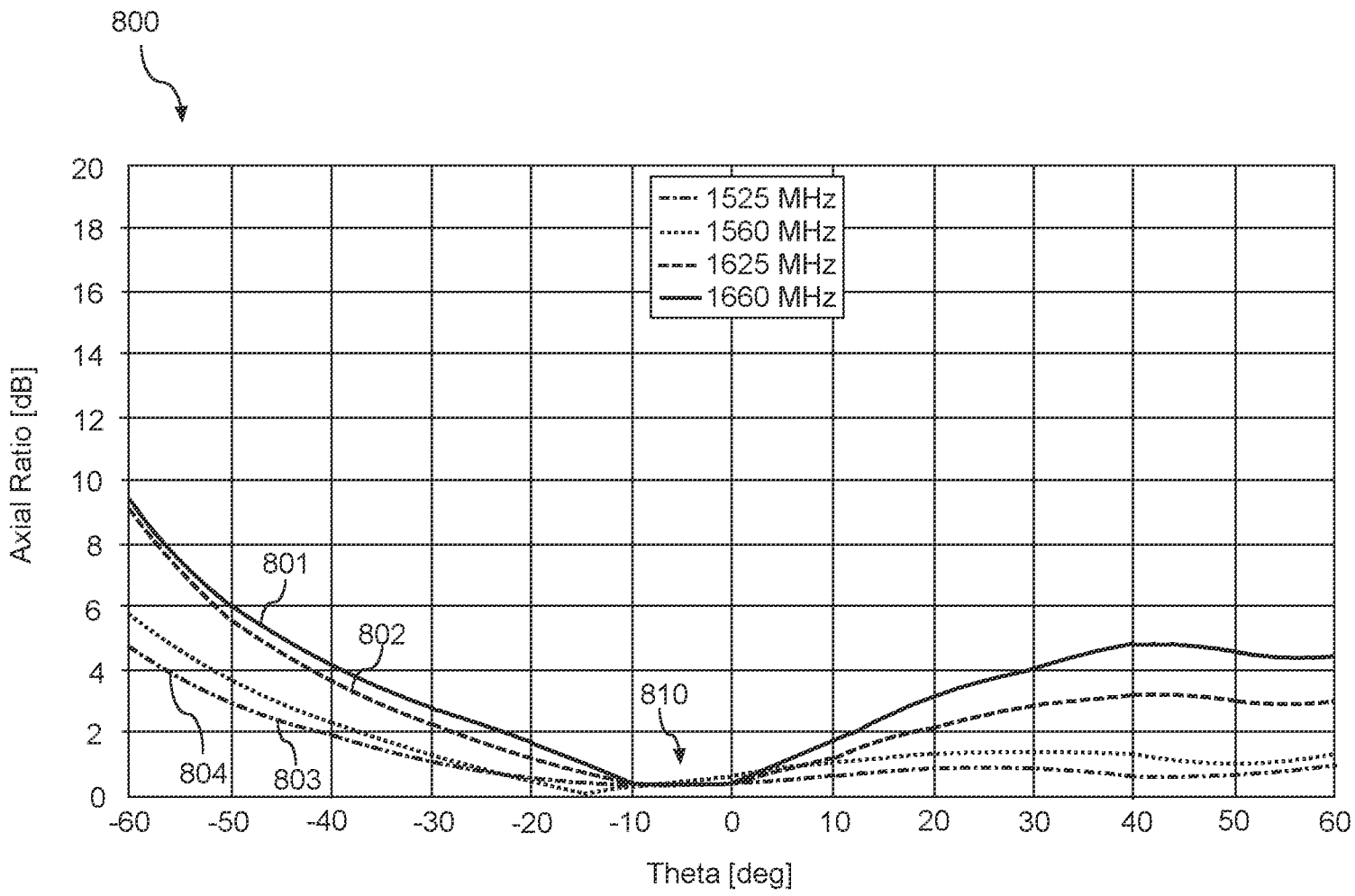
FIG. 8 depicts a plot of axial ratio for an example antenna assembly according to example aspects of the present disclosure.

FIG. 8 depicts a plot 800 of an example axial ratio of a radiation pattern for an example antenna assembly (e.g., such as, but not necessarily, any of antenna assemblies 100, 200, 300, 400, 500 of FIGS. 1-5) according to example aspects of the present disclosure. In particular, FIG. 8 depicts axial ratio of a radiation pattern at a certain angular position θ. For example, axial ratio can be depicted with respect to a lateral dimension, such as illustrated by the dimension φ in FIG. 1. As another example, the axial ratio can be depicted with respect to a longitudinal dimension, such as illustrated by the dimension θ in FIG. 1.

In some cases, axial ratio of a radiation pattern can vary with respect to frequency. For instance, each of the curves 801-804 in FIG. 8 depicts axial ratio of a radiation pattern at a particular frequency. As illustrated for the example radiation pattern depicted in FIG. 8, a higher frequency is generally associated with a higher axial ratio, although some radiation patterns may illustrate different trends. Additionally, as illustrated for the example radiation pattern depicted in FIG. 8, an example antenna assembly achieves a minimum axial ratio at angular positions around boresight 810 (i.e., at about zero degrees along the 0 dimension). For instance, in the example radiation pattern of FIG. 8, broadsight 810 can refer to an acute angular range around zero degrees θ, such as from about −10 degrees to 10 degrees. As depicted in FIG. 8, the example antenna assembly can achieve an axial ratio of less than or equal to about 3 dB at boresight 810.

Figure 9:
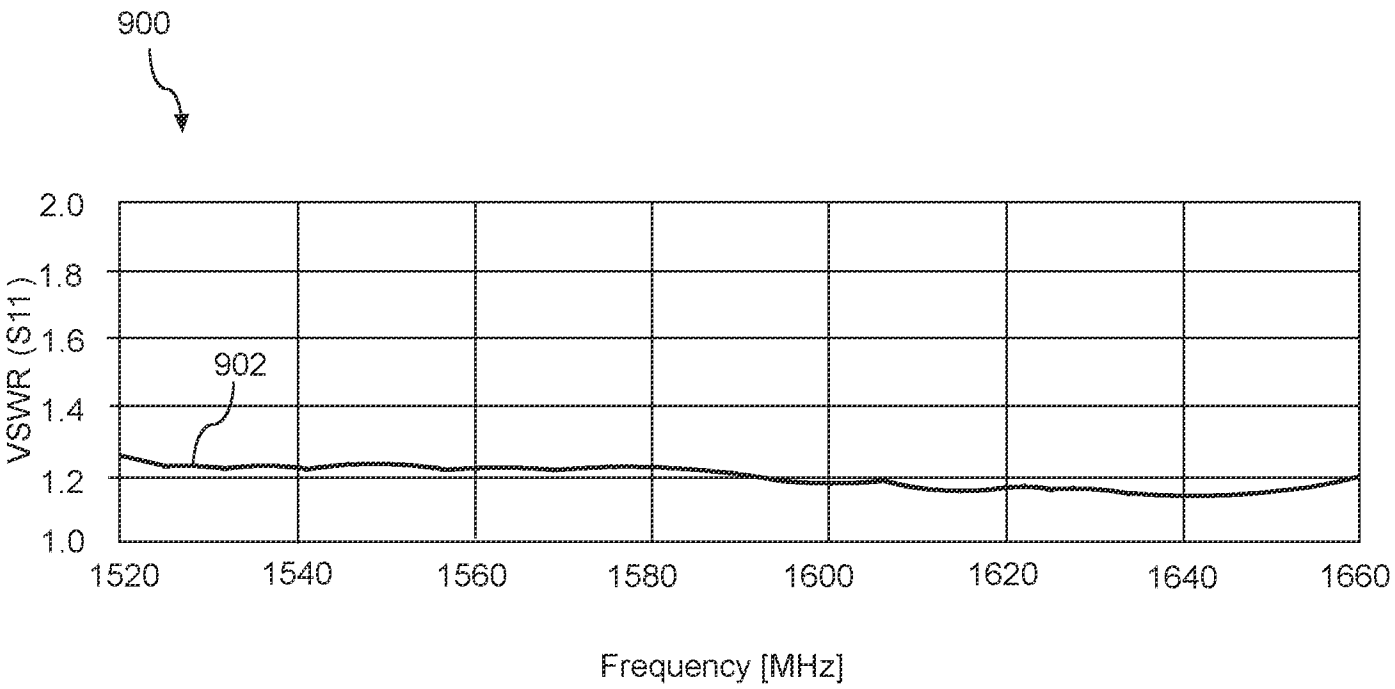
FIG. 9 depicts a plot of voltage standing wave ratio for an example antenna assembly according to example aspects of the present disclosure.

FIG. 9 depicts a plot 900 of an example voltage standing wave ratio (VSWR) of an example antenna assembly (e.g., such as, but not necessarily, any of antenna assemblies 100, 200, 300, 400, 500 of FIGS. 1-5) according to example aspects of the present disclosure. In particular, FIG. 9 depicts curve 902 representing VSWR ratio of an example antenna assembly with respect to frequency. As illustrated in FIG. 9, an example antenna assembly can achieve a relatively low and/or constant VSWR over a frequency band, such as an L-band. For instance, the example antenna assembly of FIG. 9 can achieve a VSWR of less than about 1.3 (e.g., a ratio of 1.3:1) over a frequency band, such as an L-band.

Figure 10:
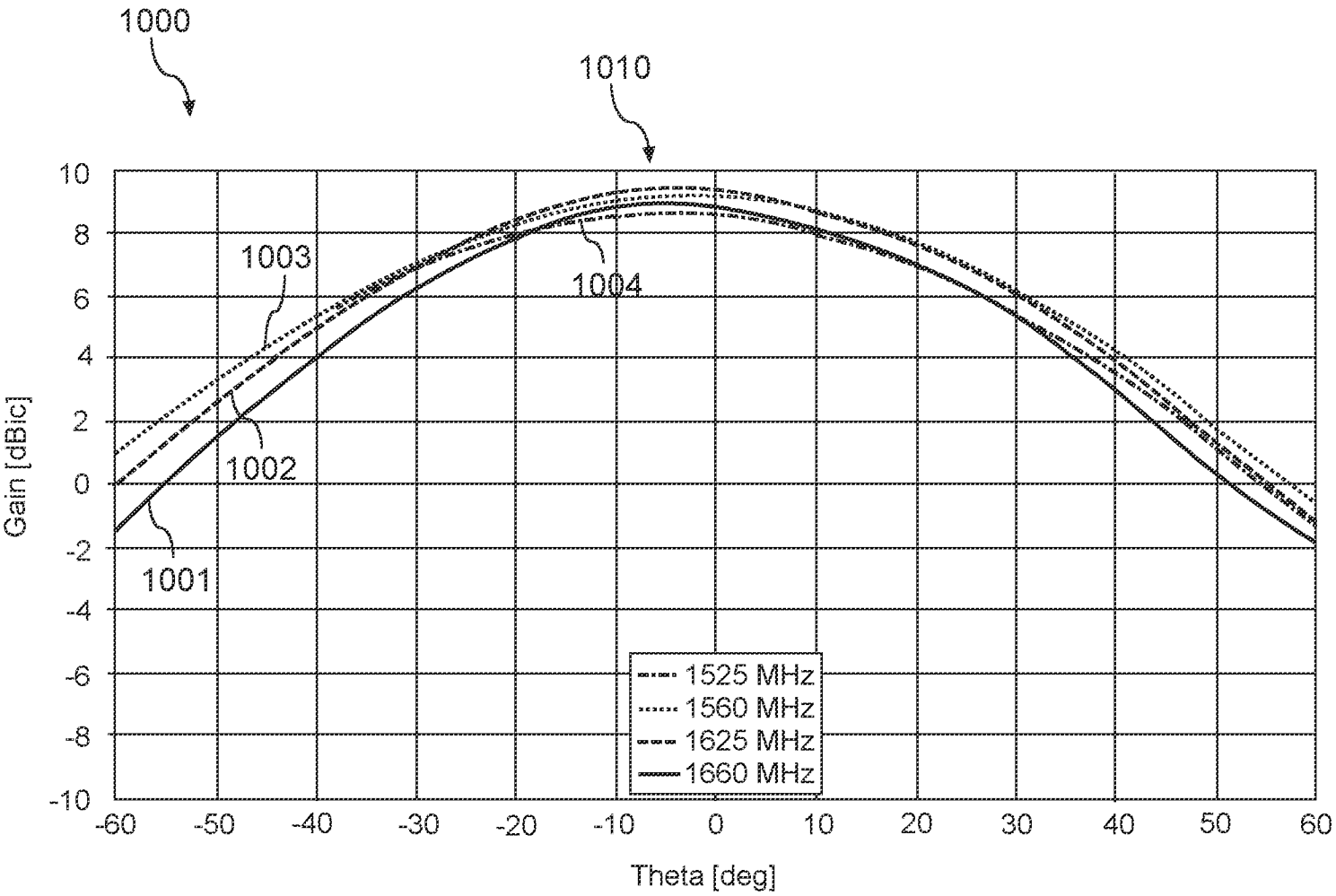
FIG. 10 depicts a plot of left hand circularly polarized gain for an example antenna assembly according to example aspects of the present disclosure.

FIG. 10 depicts a plot 1000 of an example left hand circularly polarized (LHCP) gain of an example antenna assembly (e.g., such as, but not necessarily, any of antenna assemblies 100, 200, 300, 400, 500 of FIGS. 1-5) according to example aspects of the present disclosure. In particular, FIG. 10 depicts LHCP gain of an example antenna assembly at a certain angular position θ. For example, LHCP gain can be depicted with respect to a lateral dimension, such as illustrated by the dimension φ in FIG. 1. As another example, LHCP gain can be depicted with respect to a longitudinal dimension, such as illustrated by the dimension θ in FIG. 1.

In some cases, axial ratio of a radiation pattern can vary with respect to frequency. For instance, each of the curves 1001-1004 in FIG. 10 depicts LHCP gain of an example antenna assembly at a particular frequency. As illustrated for the example antenna assembly depicted in FIG. 10, the example antenna assembly generally exhibits a parabolic LHCP gain, with a maximum at around broadsight 1010 (i.e., at about zero degrees along the θ dimension). For instance, in the example radiation pattern of FIG. 10, broadsight 1010 can refer to an acute angular range around zero degrees θ, such as from about −10 degrees to 10 degrees.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An antenna assembly comprising:

a ground plane disposed on a substrate;

a patch antenna structure spaced apart from the ground plane;

one or more grounded posts coupled to and extending from the substrate, wherein the one or more grounded posts are arranged along at least a portion of a periphery of the patch antenna structure; and one or more variable reactive elements coupled to at least one grounded post of the one or more grounded posts, the one or more variable reactive elements configured to tune a reactance of the at least one grounded post.

2. The antenna assembly of claim 1, wherein the patch antenna structure is configured to receive a transmit signal, wherein the patch antenna structure emits a radiation pattern based at least in part on the transmit signal.

3. The antenna assembly of claim 2, wherein the radiation pattern induces a resultant field in the one or more grounded posts to adjust a characteristic of the radiation pattern.

4. The antenna assembly of claim 1, wherein the one or more grounded posts are arranged along an entire periphery of the patch antenna structure.

5. The antenna assembly of claim 1, wherein the one or more grounded posts are uniformly spaced along the at least a portion of the periphery of the patch antenna structure.

6. The antenna assembly of claim 1, wherein the one or more grounded posts are nonuniformly spaced along the at least a portion of the periphery of the patch antenna structure.

7. The antenna assembly of claim 1, wherein the at least a portion of the periphery of the patch antenna structure comprises one or more sides, and wherein at least one of the one or more grounded posts is aligned with a center of at least one of the one or more sides.

8. The antenna assembly of claim 1, wherein the at least a portion of the periphery of the patch antenna structure comprises one or more corners, and wherein at least one of the one or more grounded posts is aligned with at least one of the one or more corners.

9. The antenna assembly of claim 1, wherein the one or more grounded posts extend a height from the substrate, and wherein the height is greater than a spacing between the patch antenna structure and the ground plane.

10. The antenna assembly of claim 1, wherein the one or more grounded posts extend a height from the substrate, and wherein the height is equivalent to a spacing between the patch antenna structure and the ground plane.

11. The antenna assembly of claim 1, wherein a shape of the one or more grounded posts varies along a height of the one or more grounded posts.

12. The antenna assembly of claim 1, wherein a first grounded post of the one or more grounded posts is coupled to a second grounded post of the one or more grounded posts by a coupling element, the coupling element being distinct from the ground plane.

13. The antenna assembly of claim 1, wherein the patch antenna structure comprises a square planar shape.

14. The antenna assembly of claim 1, wherein the patch antenna structure is configured to produce a receive signal based at least in part on an incident electric field.

15. The antenna assembly of claim 1, wherein the patch antenna structure is elliptically polarized.

16. The antenna assembly of claim 1, wherein the patch antenna structure comprises:

a planar portion spaced apart from the ground plane, the planar portion disposed parallel to the ground plane; and one or more feed legs extending from the planar portion.

17. The antenna assembly of claim 16, wherein the patch antenna structure comprises a second planar portion spaced apart from the planar portion, the second planar portion disposed parallel to the planar portion.

18. An antenna assembly comprising:

a ground plane disposed on a substrate;

a patch antenna structure spaced apart from the ground plane, the patch antenna structure comprising:

a planar portion spaced apart from the ground plane, the planar portion disposed parallel to the ground plane, the planar portion comprising a square planar shape; and one or more feed legs extending from the planar portion, wherein the one or more feed legs are arranged in a perpendicular configuration;

one or more grounded posts coupled to and extending from the ground plane, each of the one or more grounded posts extending a uniform height from the ground plane, wherein the uniform height is greater than a spacing between the ground plane and the planar portion; and one or more variable reactive elements coupled to at least one grounded post of the one or more grounded posts, the one or more variable reactive elements configured to tune a reactance of the at least one grounded post;

wherein the one or more grounded posts comprise a hollow cylindrical shape;

wherein the one or more grounded posts are evenly spaced along an entire periphery of the patch antenna structure, wherein the one or more grounded posts are aligned with each of a plurality of corners of the square planar shape and aligned with a center of each of a plurality of sides of the square planar shape.

19. The antenna assembly of claim 18, wherein the one or more feed legs are configured to receive an RF signal, wherein at least one of the planar portion and the one or more feed legs emit a radiation pattern in response to the RF signal, and wherein the radiation pattern induces a resultant field in the one or more grounded posts to adjust a characteristic of the radiation pattern.

* * * * *